United States Patent [19]

Schrewe et al.

[11] 3,996,994

[45] Dec. 14, 1976

[54] SUPPLYING MOLTEN METAL TO A MOLD FOR CONTINUOUS CASTING

[75] Inventors: Hans Schrewe, Duisburg; Klaus Frenken, Krefeld-Bockum, both of Germany

[73] Assignee: Mannesmann Aktiengesellschaft, Dusseldorf, Germany

[22] Filed: Sept. 2, 1975

[21] Appl. No.: 609,645

[30] Foreign Application Priority Data

Sept. 2, 1974 Germany ..... 2442187

[52] U.S. Cl. ..... 164/281 R; 222/DIG. 1

[51] Int. Cl.[2] ..... B22D 11/10

[58] Field of Search ..... 164/281; 222/DIG. 1

[56] References Cited

UNITED STATES PATENTS

| | | | |
|---|---|---|---|
| 3,888,294 | 6/1975 | Fastner | 164/281 |

FOREIGN PATENTS OR APPLICATIONS

| | | | |
|---|---|---|---|
| 1,492,871 | 8/1967 | France | 164/281 |
| 240,211 | 8/1969 | U.S.S.R. | 164/281 |

*Primary Examiner*—Gil Weidenfeld
*Attorney, Agent, or Firm*—Ralf H. Siegemund

[57] ABSTRACT

A feeder pipe for a mold for continuous casting of steel has near-rectangular inner and outer contour with oppositely directed discharge ports on the small sides of the rectangle feeding towards the small sides of the rectangle of a mold for casting of ingot with rectangular contour.

2 Claims, 3 Drawing Figures

SUPPLYING MOLTEN METAL TO A MOLD FOR CONTINUOUS CASTING

BACKGROUND OF THE INVENTION

The present invention relates to charging a mold for continuous casting and more particularly the invention relates to structure for feeding molten material, perferably metal into a mold underneath the surface level thereof, the mold being provided for casting ingots with rectangular cross-section.

Feeding devices of this type are known and they provide particularly for flow of molten metal from a distributor, ladle and/or tundish, etc. into the mold. The feeding structure dips, of course, into the molten bath to discharge the metal underneath the surface of the liquidous content of the mold. The dipping structure must have a configuration, particularly as to its outer contour, so that the flow pattern in the mold is not detrimentally interfered with. Known structure, particularly for casting rectangular ingots, are not completely satisfactory on this point.

DESCRIPTION OF THE INVENTION

It is an object of the present invention to provide a new and improved discharge device for feeding molten material into a mold for continuous casting of ingot with rectangular cross-section.

In accordance with the preferred embodiment of the invention, it is suggested to provide a discharge pipe for feeding molten material into a mold for continuous casting, which pipe has rectangular inner and outer cross-sections, at least where being submerged in the bath of molten material in the mold, whereby the edges of this contour of the pipe run parallel to the sides of the mold, and long and short sides of the rectangular contour respectively extend parallel to long and short mold sides, while the front end of the pipe is round, pologonal or flat. The exit or discharge openings of the pipe are straight and have an orientation with an upwardly or downwardly directed angle. The largest diagonal dimension of the submerged portion of the pipe is smaller than the smallest diameter of the entrance portion (above the surface level of the molten material).

DESCRIPTION OF THE DRAWING

While the specification concludes with claims particularly pointing out and distinctly claiming the subject matter which is regarded as the invention. It is believed that the invention, the objects and features of the invention and further objects, features and advantages thereof will be better understood from the following description taken in connection with the accompanying drawings, in which:

Figure 1:
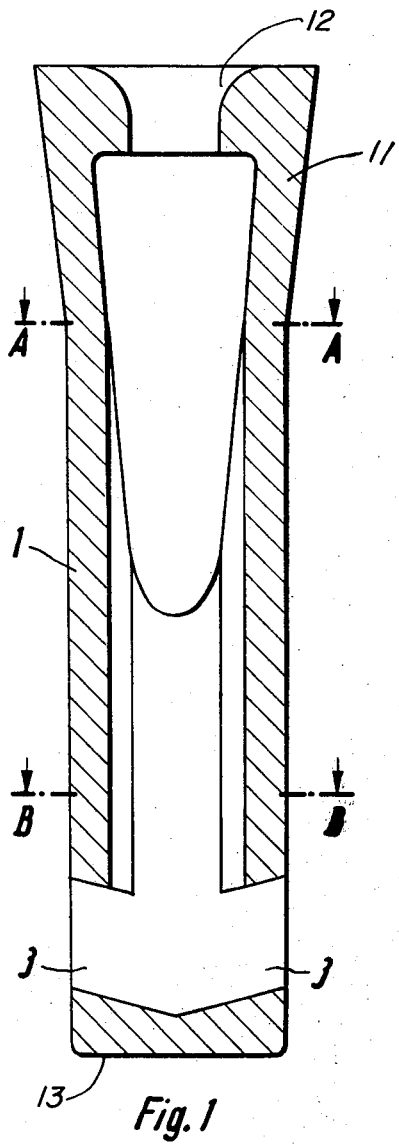
FIG. 1 is a longitudinal section through a feeder pipe in accordance with the preferred embodiment of the invention.

Proceeding now to the detailed description of the drawings, a feeder pipe 1 has a conically enlarged upper portion 11 with flare entrance opening 12 for connection to a ladle, tundish, or the like and to receive therefrom molten metal, such as molten steel. The upper portion of pipe 1, including portions underneath conically enlarged section 11, has circular inner and outer cross-sections as can be seen from FIG. 2. These circular cross-sections change gradually into a more rectangular configuration of inner cross-section 2 and outer cross-section 4. However, the corners are flattened in both instances.

Figure 2:
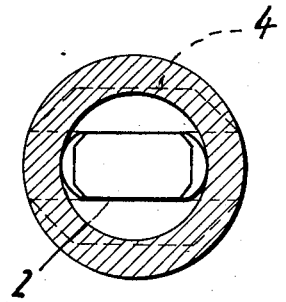
FIG. 2 is a section along line AA in FIG. 1.

The longitudinal edges of the pipe extend parallel to the mold sides. The largest diagonal dimension of the inner rectangle 2 is smaller than the circular contour of the interior of pipe 1 in and above the section plane A—A, i.e. inside of conical portion 11. FIG. 2 shows best the diameter vs. diagonal relationship.

The pipe 1 is closed axially across the bottom, but has lateral exit ports 3 which have also rectangular cross-section. The axes of these two ports are slightly upwardly inclined, and the two ports are oriented to feed in opposite directions, towards the small sides of the rectangular interior of the mold. These exit ports 3 have rectangular cross-section, possibly even square ones. The front faces of the pipe could be round, polygonal or flat.

Figure 3:
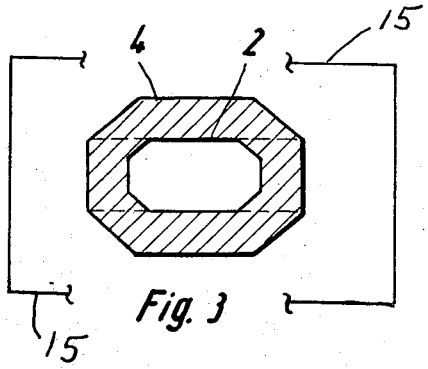
FIG. 3 is a section along line BB in FIG. 1.

The long sides of the rectangles of the feeder pipe extend parallel to the long sides of the mold 15 as shown in FIG. 3. Thus, the flow space as between long sides of the mold and the long sides of the (outer) pipe rectangle is used to an optimum extent.

The invention is not limited to the embodiments described above, but all changes and modifications thereof not constituting departures from the spirit and scope of the invention are intended to be included.

We claim:

1. A discharge pipe in combination with a mold, for feeding molten material into the mold for continuous casting, the mold having rectangular cross-section for casting ingots of rectangular cross-section, the pipe being disposed to be submerged partially in the molten material, said discharge pipe comprising an upper conical portion converging downwardly into a lower portion, said lower portion having inner and outer essentially rectangular parallel cross-sections at least in the region of submerse into the molten material in the mold said inner rectangular cross-section having a maximum diagonal smaller than the minimum diameter of the upper portion;

the pipe being disposed so that the long sides of the lower rectangular portion extend parallel to the long mold sides; and the pipe being closed at the bottom and having lateral, straight exit openings at the short sides of the rectangle, the openings being inclined relative to a horizontal plane.

2. A discharge pipe as in claim 1, said discharge openings being rectangular.

* * * * *